US007173597B2

(12) United States Patent
Kato

(10) Patent No.: US 7,173,597 B2
(45) Date of Patent: Feb. 6, 2007

(54) SIGNAL-ADJUSTED LCD CONTROL UNIT

(75) Inventor: Fumihiko Kato, Yamagata (JP)

(73) Assignee: NEC Electronics Corporation, Kanagawa (JP)

( * ) Notice: Subject to any disclaimer, the term of this patent is extended or adjusted under 35 U.S.C. 154(b) by 76 days.

(21) Appl. No.: 10/090,954

(22) Filed: Mar. 5, 2002

(65) Prior Publication Data

US 2002/0126112 A1 Sep. 12, 2002

(30) Foreign Application Priority Data

Mar. 6, 2001 (JP) ..... 2001-061433

(51) Int. Cl.
*G09G 3/36* (2006.01)

(52) U.S. Cl. ..... 345/99; 345/89; 345/96

(58) Field of Classification Search ..... 345/87, 345/89, 94–96, 98–100, 103, 204, 208–210, 345/690

See application file for complete search history.

(56) References Cited

U.S. PATENT DOCUMENTS 4,427,978 A * 1/1984 Williams ..... 345/89
5,572,211 A * 11/1996 Erhart et al. ..... 341/144
5,757,338 A * 5/1998 Bassetti et al. ..... 345/3.2
5,867,137 A * 2/1999 Sugiyama ..... 345/89
5,910,796 A * 6/1999 Gormish ..... 345/600
5,998,985 A * 12/1999 Gallavan ..... 324/133
6,160,533 A * 12/2000 Tamai et al. ..... 345/89
6,380,917 B2 * 4/2002 Matsueda et al. ..... 345/89
6,466,191 B1 * 10/2002 Choi et al. ..... 345/94
6,570,560 B2 * 5/2003 Hashimoto ..... 345/211

* cited by examiner

*Primary Examiner*—Bipin Shalwala
*Assistant Examiner*—Jeff Piziali
(74) *Attorney, Agent, or Firm*—Muirhead & Saturnelli, LLC

(57) ABSTRACT

An LCD control unit includes a software adjustment block for adjusting the γ-correction voltages by a software. The LCD control unit includes a voltage generator block generating n γ-correction voltages and m Vcom voltages based on a voltage address signal, a voltage selecting block selecting a pair of γ-correction voltages and a Vcom voltage based on a time series polarity control signal, and an LCD driver having a γ-correction resistor string which receives the γ-correction voltages at both the ends thereof. The LCD driver converts external data signals into display voltages having voltages corrected by the outputs from the γ-correction resistor string.

9 Claims, 5 Drawing Sheets

SIGNAL-ADJUSTED LCD CONTROL UNIT

BACKGROUND OF THE INVENTION (a) Field of the Invention

The present invention relates to a signal-adjusted LCD control unit and, more particularly, to an LCD control unit in an LCD device which is capable of being adjusted by software to conform to the γ-profile of the LCD panel in the LCD device.

(b) Description of the Related Art

Liquid crystal display (LCD) devices are increasingly used as display devices in a portable electronic equipment including a computer system, such as a mobile telephone. Among other LCD devices, the LCD device used in the mobile telephone is especially requested to have smaller dimensions and smaller weight.

FIG. 1 shows a conventional LCD device, which includes an LCD panel 60, an LCD driver 40 and an LCD controller 70. The LCD driver 40 is formed as a one-chip IC, mounted on the LCD panel 60 for driving the LCD panel 60. The LCD controller 70 is disposed separately from the LCD panel 60 and the LCD driver 40. The LCD controller 70 includes a γ-correction resistor string 71, an impedance converter 72, a voltage divider 73 and a Vcom-voltage generator 74.

Both the γ-correction resistor string 71 and the voltage divider 73 are connected between a high-voltage source line $V_{CC}$ and a low-voltage source line $V_{SS}$ to generate a plurality (n) of voltages and a plurality (m) of voltages, respectively. The impedance converter 72 converts the impedance of the plurality of voltages supplied from the taps of the γ-correction resistor string 71 to output a plurality of γ-correction voltages 103, which are fed to the LCD driver 40. Each signal line transferring one of the γ-correction voltages 103 is provided with a smoothing capacitor or bypass capacitor (not shown). The LCD driver 40 generates display voltage signals 108 based on the data signal 107 supplied outside from the LCD device and the γ-correction voltages 103, delivering the display data signal 108 to the data electrodes of the LCD panel 60.

The Vcom-voltage generator 74 generates a plurality of Vcom voltages 104 based on the voltages supplied from the voltage divider 73, the Vcom voltages 104 being supplied to the common electrode of the LCD panel 60. The LCD panel 60 is thus driven by the display data signals 108 and the Vcom voltages 104 based on an AC driving scheme to display on the screen thereof images including characters and pictures.

In the conventional LCD device as described above, the LCD driver 40 and the LCD controller 70 have different functions, and are generally disposed outside the LCD panel 60 separately from one another.

It is known that the LC layer of the LCD panel 60 exhibits a non-linearity of optical transmittance with respect to the display voltage signal applied therethrough. In view of this fact, the LCD driver 40 supplies specific display data signals 108, which are corrected based on the γ-correction voltages corresponding to the γ-profile of the optical transmittance of the LC layer, thereby effecting a suitable contrast on the screen of the LCD panel 60.

Otherwise, if a DC voltage is applied to the LC layer, an electro-chemical reaction arises on the surface of the electrodes of the LCD panel, whereby the lifetime of the LCD panel 60 will be significantly reduced. The AC driving scheme is such that the polarity of the drive voltage between the data electrodes and the common electrode is reversed at a constant cycle. The applied AC voltage, however, are often subjected to deformation of the waveform to cause an inequality in the waveform between the positive-polarity duration and the negative-polarity duration of the applied voltage. The inequality of the waveform in fact generates some DC component of the applied voltage signal, thereby causing an undesirable phenomenon such as flickering of the screen. The Vcom voltages as described above cancel the inequality of the waveform by changing the voltage level of the common electrode between both the durations, to thereby suppress the adverse effect by the DC component.

The γ-correction voltages and the Vcom voltages respectively have suitable values corresponding to the inherent characteristics of the respective LCD panels. This necessitates an initial adjustment of the γ-correction voltages and the Vcom voltages before the LCD panel is installed in service. The initial adjustment is generally conducted by a hardware work which determines the resistances of resistors of the γ-correction resistor string 71 and the voltage divider 73 provided as external resistors. In particular, the resolution of the γ-voltages generated by the γ-correction resistor string 71 is reduced after the adjustment by the external resistors, which necessitates incorporation of additional resistors to cancel the reduction of the resolution and thus complicates the work for the hardware adjustment.

In addition, the hardware adjustment of the LCD device especially increases the costs and the dimensions thereof due to the complicated structure of the LCD device including the LCD panel 60, LCD driver 40, the LCD controller 70 and the external members associated therewith.

SUMMARY OF THE INVENTION

In view of the above problems in the conventional LCD device, it is an object of the present invention to provide an LCD control unit for use in an LCD device, which is capable of being adjusted by a signal such as a software and thus reducing the dimensions and costs of the LCD device.

The present invention provides an LCD control unit for driving an LCD panel in an LCD device, said LCD control unit comprising:

a signal controller for generating a voltage address signal and a polarity control signal;

a voltage generator block for generating a plurality of (n) γ-voltage levels and a plurality of (m) Vcom-voltage levels based on said voltage address signal, a voltage selecting block for selecting a specified number of said γ-voltage levels and one of said Vcom-voltage levels based on said polarity control signal to output said specified number of γ-correction voltages and a Vcom voltage; and an LCD driver for generating a set of display data signals based on a set of external data signals, said LCD driver including a γ-correction section for correcting voltages of said display data signals based on said specified number of γ-correction voltages.

In accordance with the LCD control unit of the present invention, since the γ-correction voltages can be corrected based on the specified number of γ-voltage levels, adjustment for the γ-correction voltages can be effected by software work, without including a hardware work.

The above and other objects, features and advantages of the present invention will be more apparent from the following description, referring to the accompanying drawings.

PREFERRED EMBODIMENTS OF THE INVENTION

Figure 1:
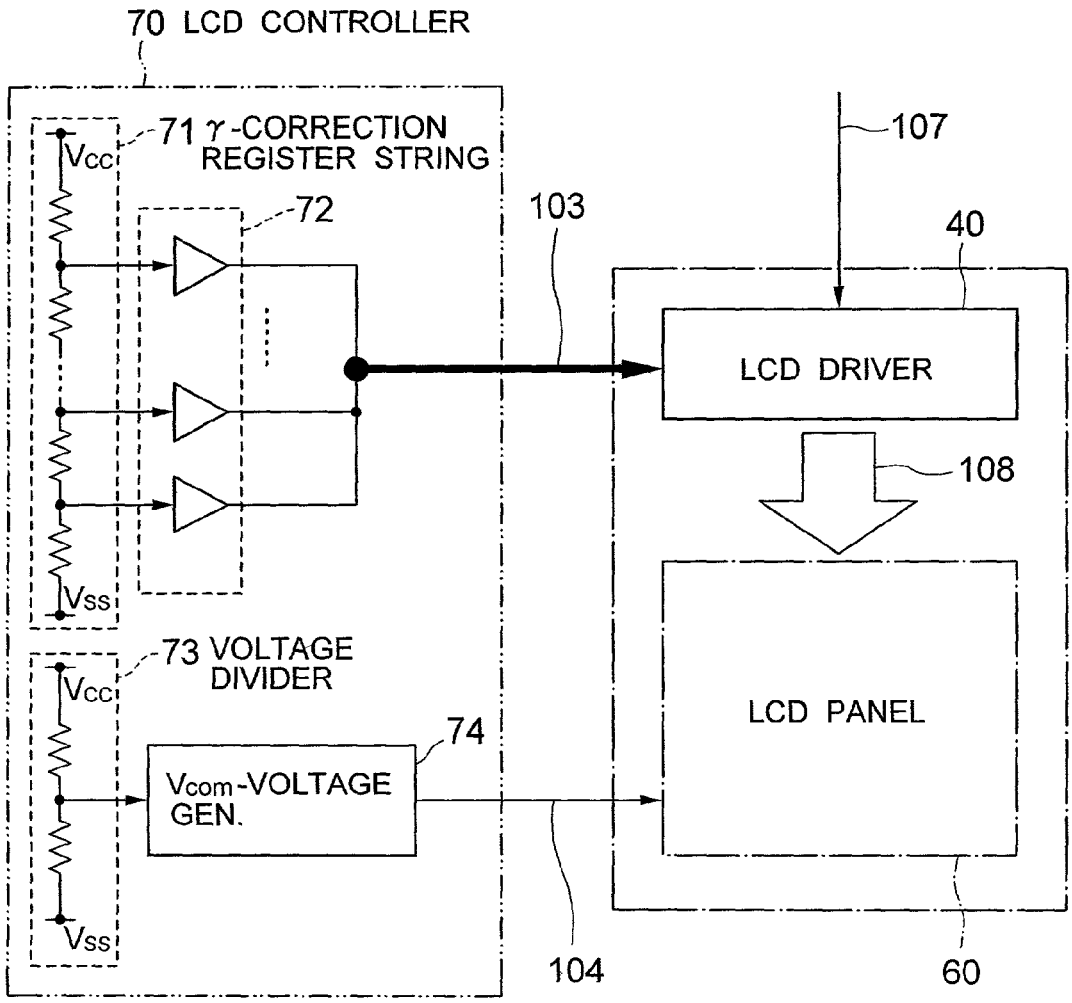
FIG. 1 is a block diagram of a conventional LCD device.

Now, the present invention is more specifically described with reference to accompanying drawings, wherein similar constituent elements are designated by similar reference numerals throughout the drawings.

Figure 2:
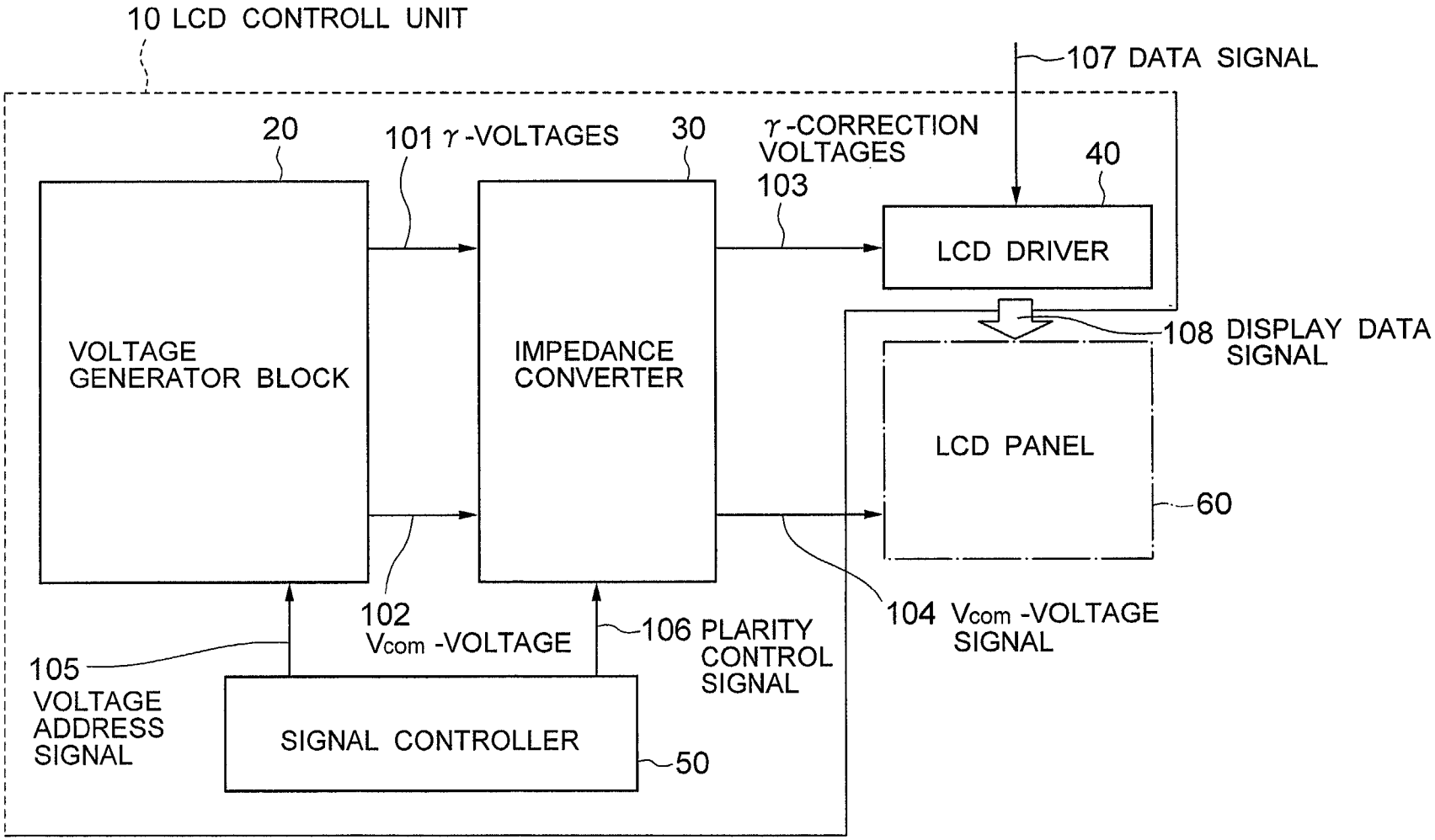
FIG. 2 is a block diagram of an LCD device including an LCD control unit according to an embodiment of the present invention.

Referring to FIG. 2, an LCD device includes an LCD panel 60 and an LCD control unit 10 according to an embodiment of the present invention. The LCD control unit 10 includes a signal controller (or software adjustment block) 50 for generating a voltage address signal 105 and a polarity control signal 106, a voltage generator block 20 for generating a plurality of (n) γ-voltages 101 and a plurality of (m) Vcom voltages 102 based on the voltage address signals 105, an impedance converter (or voltage selecting block) 30 for converting the impedances of the γ-voltages 101 and the Vcom voltages 102 and selecting some of the γ-correction voltages 103 and the Vcom-voltage signals 104 based on the polarity control signal 106, and an LCD driver 40 for generating display voltage signals 108 based on the data signals 107 supplied from outside the LCD device and the γ-correction voltages 103. The Vcom-voltage signals 104 are supplied to the LCD panel 60 for driving the LCD panel 60 in an AC driving scheme while canceling the DC component of the display data signals 108.

The LCD control unit 10 is manufactured as a one-chip IC mounted on the LCD panel 60. The configuration of the LCD control unit 10 significantly reduces the dimensions and weight of the LCD device.

The signal controller 50 supplies the voltage address signal 105 to the voltage generator block 20, and the polarity control signal 106 to the impedance converter 30. The voltage generator block 20 generates n γ-voltages 101 and m Vcom voltages 102 based on the voltage address signal 105, and delivers the γ-voltages 101 and the Vcom voltages 102 to the impedance converter 30.

The impedance converter 30 converts the internal impedances of the γ-voltages 101 and the Vcom voltages 102 to generate γ-correction signals 103 and Vcom-voltage signals 104, which are delivered to the LCD driver 40 and the LCD panel 60, respectively. The LCD driver 40 converts the data signal 107 to the display data signals 108 by using the γ-correction voltages, and delivers the display data signals **108*d* to the LCD panel 60**.

Figure 3:
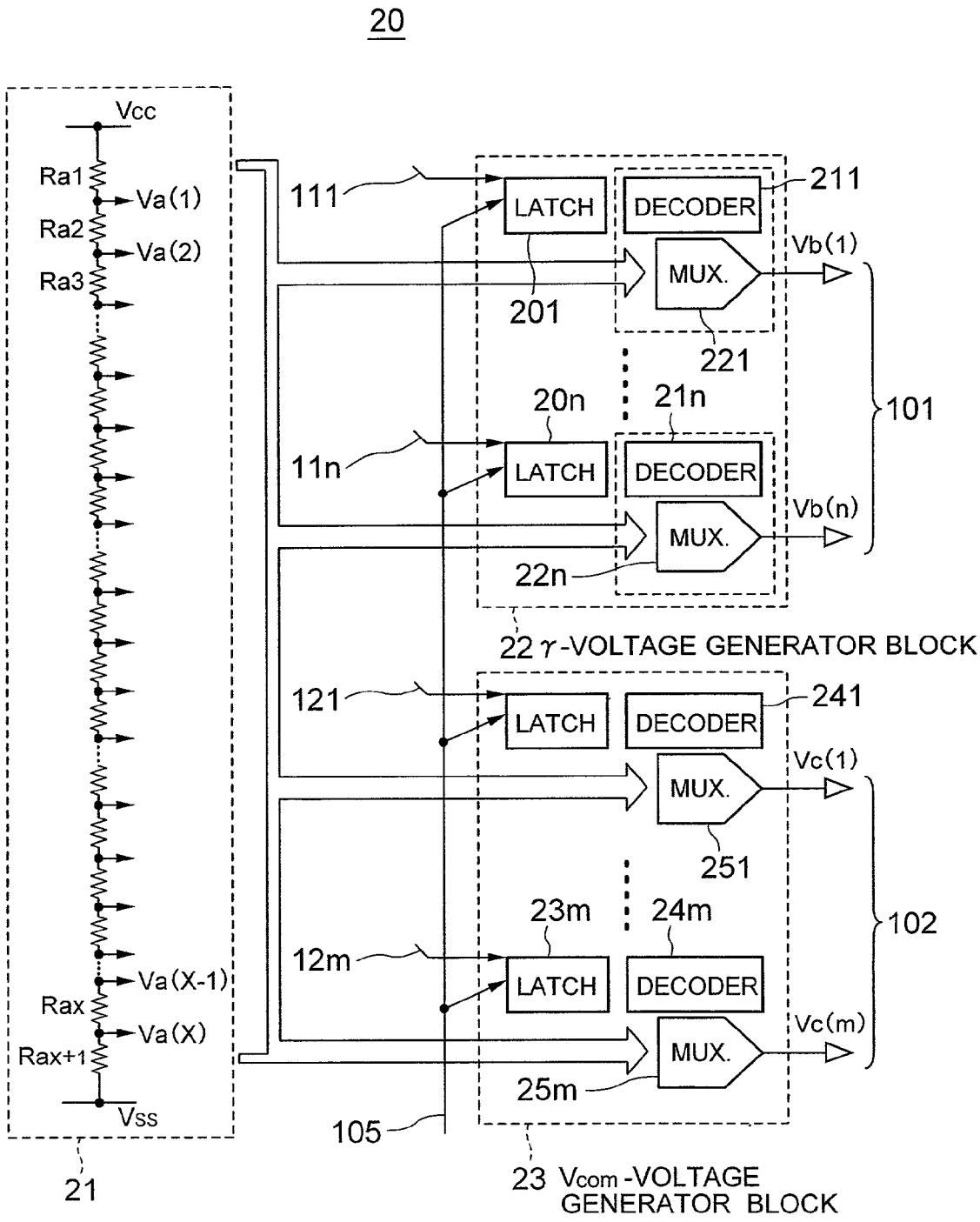
FIG. 3 is a block diagram of the voltage generator block shown in FIG. 2.

Referring to FIG. 3, the voltage generator block 20 includes an adjustment resistor string 21, a γ-voltage generator block 22 and a Vcom-voltage generator block 23. The adjustment resistor string 21 includes a plurality of (X+1) resistors $R_{a1}$–$R_{ax+1}$ connected in series between a high-potential source line $V_{CC}$ and a low-potential source line $V_{SS}$.

The resistors $R_{a1}$–$R_{ax+1}$ have the resistances substantially equal to one another, and equally divide the voltage between the high-potential source line $V_{CC}$ and the low-potential source line $V_{SS}$ to generate X voltage levels Va(1)–Va(X), which are delivered to the γ-voltage generator block 22 and some of which are delivered to the Vcom-voltage generator block 23.

The γ-voltage generator block 22 includes n data latches $\mathbf{20}_1$–$\mathbf{20}_n$, n decoders $\mathbf{21}_1$–$\mathbf{21}_n$, and n multiplexers $\mathbf{22}_1$–$\mathbf{22}_n$. For example, n is four. Data latch $\mathbf{20}_1$, decoder $\mathbf{21}_1$, and multiplexer $\mathbf{22}_1$ constitute a first γ-voltage generator section, whereas data latch $\mathbf{20}_n$, decoder $\mathbf{21}_n$ and multiplexer $\mathbf{22}_n$ constitute n-th γ-voltage generator section.

The Vcom-voltage generator block 23 includes m data latches $\mathbf{23}_1$–$\mathbf{23}_m$, m decoders $\mathbf{24}_1$–$\mathbf{24}_m$, and m multiplexers $\mathbf{25}_1$–$\mathbf{25}_m$. Data latch $\mathbf{23}_1$, decoder $\mathbf{24}_1$ and multiplexer $\mathbf{25}_1$ constitute a first Vcom-voltage generator section, whereas data latch $\mathbf{23}_m$, decoder $\mathbf{24}_m$ and multiplexer $\mathbf{25}_m$ constitute a m-th Vcom-voltage generator section.

The adjustment resistor string 21 generates X (=n×L) voltage levels at respective taps thereof, and delivers voltage levels Va(1)–Va(L) to multiplexer $\mathbf{22}_1$, voltage levels Va(L+1)–Va(2L) to multiplexer $\mathbf{22}_2$, . . . , and voltages levels Va((n−1)L+1)–Va(nL) to multiplexer $\mathbf{22}_n$.

The adjustment resistor string 21 delivers voltages Va(1)–Va(L) to multiplexer $\mathbf{25}_1$, voltage Va(L+1)–Va(2L) to multiplexer $\mathbf{25}_2$, . . . , and voltages Va(((m/2)−1)L+1)–Va((m/2)L) to multiplexer $\mathbf{25}_{m/2}$.

The resistor string 21 delivers voltages Va(((n−(m/2))L)+1)–Va(((n−(m/2)+1)L)) to multiplexer $\mathbf{25}_{m/2+1}$, voltages Va((n−(m/2)+1)L+1)–Va ((n−(m/2)+2)L) to multiplexer $\mathbf{25}_{m/2+2}$, . . . , and voltages Va((n−1)L+1)–Va(nL) to multiplexer $\mathbf{25}_m$.

The data latches $\mathbf{20}_1$–$\mathbf{20}_n$ and $\mathbf{23}_1$–$\mathbf{23}_m$ receive respective voltage address signal 105, which specifies the addresses of the γ-voltage or Vcom voltage for each of the data latches. γ-clock signals $\mathbf{11}_1$–$\mathbf{11}_n$ and COM clock signals $\mathbf{12}_1$–$\mathbf{12}_m$ rise in synchrony with the voltage address signal 105.

The data latch $2O_1$ latches the corresponding γ-voltage address in synchrony with the -γclock signal $\mathbf{11}_1$ to deliver the latched address to the decoder $\mathbf{21}_1$. Similarly, the data latch $2O_n$ latches the corresponding γ-voltage address in synchrony with the γ-clock signal **11*n*** to deliver the latched address to the decoder $\mathbf{21}_n$. The γ-voltage address is set at an arbitrary number between zero and L during an initial adjustment, depending on the optical transmittance of the LCD panel.

The data latch $\mathbf{23}_1$ latches the corresponding Vcom-voltage address in synchrony with the COM clock signal $\mathbf{12}_1$, and delivers the latched address to the decoder $\mathbf{24}_1$. Similarly, the data latch $\mathbf{23}_n$ latches the corresponding Vcom-voltage address in synchrony with the COM clock signal **12*n***, and delivers the latched address to the decoder $\mathbf{24}_n$. The Vcom-voltage address is set at an arbitrary number between zero and L during the initial adjustment, depending on the optical transmittance of the LCD panel.

The decoders $\mathbf{21}_1$–$\mathbf{21}_n$ decode the γ-voltage address to output a γ-voltage digital signals to the multiplexers $\mathbf{22}_1$–$\mathbf{22}_n$. The decoders $\mathbf{24}_1$–$\mathbf{24}_n$ decode the Vcom-voltage address to output Vcom-voltage digital signals to the multiplexer $\mathbf{25}_1$–$\mathbf{25}_n$. Each of the multiplexers $\mathbf{22}_1$–$\mathbf{22}_n$ and $\mathbf{25}_1$–$\mathbf{25}_n$ selects one of the corresponding voltage levels Va based on the input digital voltage signal.

More specifically, the multiplexer $\mathbf{22}_1$ selects one of the voltages Va(1)–Va(L) based on the γ-voltage digital signal, delivering an analog voltage Vb(1) corresponding to the selected voltage. The multiplexer $\mathbf{22}_2$ selects one of the voltages Va(L+1)–Va(2L) based on the γ-voltage digital signal, delivering an analog voltage Vb(2) corresponding to the selected voltage. Similarly, The multiplexer $\mathbf{22}_n$ selects one of the voltages Va((n−1)L)–Va(nL) based on the γ-voltage digital signal, delivering an analog voltage Vb(n) corresponding to the selected voltage.

The multiplexer $\mathbf{25}_1$ selects one of the voltages Va(1)–Va(L) based on the Vcom-voltage digital signal, delivering an analog voltage Vc(1) corresponding to the selected voltage. The multiplexer $\mathbf{25}_2$ selects one of the voltages Va(L+1)–Va(2L) based on the Vcom-voltage digital signal, delivering an analog voltage Vc(2) corresponding to the selected voltage. Similarly, the multiplexer $\mathbf{25}_{m/2}$ selects one of the voltages Va(((m/2)−1)L)+1)–Va((m/2)L) based on the Vcom-voltage digital signal, delivering an analog voltage Vc(m/2) corresponding to the selected voltage.

The multiplexer $\mathbf{25}_{m/2+1}$ selects one of the voltages Va((n−(m/2))L+1)–Va((n−(m/2)+1)L) based on the Vcom-voltage digital signal, delivering an analog voltage Vc((m/2)+1) corresponding to the selected voltage. The multiplexer $\mathbf{25}_{m/2+2}$ selects one of the voltages Va(((n−(m/2)+1)L)+1)–Va((n−(m/2)+2)L) based on the Vcom-voltage digital signal, delivering an analog voltage Vc(m/2+2) corresponding to the selected voltage. Similarly, The multiplexer $\mathbf{25}_m$ selects one of the voltages Va((n−1)L+1)–Va(nL) based on the Vcom-voltage digital signal, delivering an analog voltage Vc(m) corresponding to the selected voltage.

Each decoder and a corresponding multiplexer function as a D/A converter, which receives a digital voltage signal specifying a specific voltage to thereby output an analog voltage signal having a value specified by the digital voltage signal.

Figure 4:
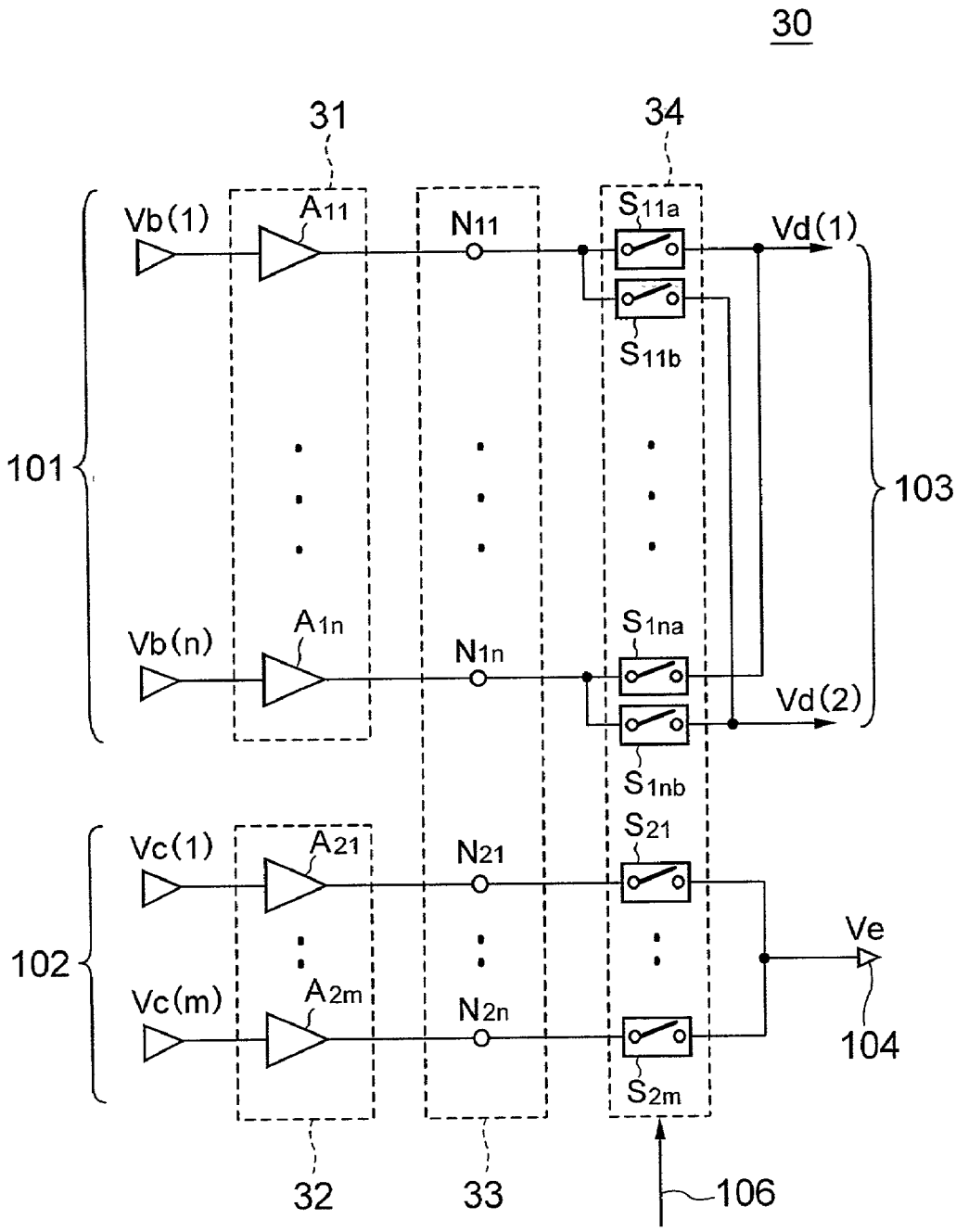
FIG. 4 is a block diagram of the impedance converter shown in FIG. 2.

Referring to FIG. 4, the impedance converter 30 includes a γ-voltage operational amplifier block 31, a Vcom-voltage operational amplifier block 32, a capacitor block 33, and a switch block 34. The γ-voltage operational amplifier block 31 includes n operational amplifiers A11–A1n each receiving a corresponding one of the γ-voltages Vb(1)–Vb(n). The Vcom-voltage operational amplifier block 32 includes m operational amplifiers A21–A2m each receiving a corresponding one of the Vcom voltages Vc(1)–Vc(m). Each operational amplifier operates as a voltage follower for impedance conversion, and delivers an output voltage corresponding to the input voltage.

The switch block 34 includes a first switch group including n switches S11*a*–S11n*a*, a second switch group including n switches S11*b*–S1n*b*, and a third switch group including m switches S21–S2m, each of the switches being controlled by a polarity control signal 106 for effecting the AC driving scheme.

The capacitor block 33 includes (n+m) capacitors each shown by a node N11–N1n and N21–N2m in the drawing. Each capacitor is associated with a corresponding operational amplifier, absorbing the fluctuation of the potential at the output node of the corresponding operational amplifier.

Operational amplifier A11 receives a γ-voltage Vb(1), and delivers the same after the impedance conversion thereof through switch S11*a* or S11*b* as a γ-correction voltage Vd(1) or Vd(2). Operational amplifier A12 receives a γ-voltage, and delivers the same after the impedance conversion through switch S12*a* or S12*b* as the γ-correction voltage Vd(1) or Vd(2). Similarly, operational amplifier A12 receives a γ-voltage Vb(n), and delivers the same after the impedance conversion through switch S1n*a* or S1n*b* as the γ-correction voltage Vd(1) or Vd(2).

Operational amplifier A21 receives a Vcom voltage Vc(1) and delivers the same after the impedance conversion through switch S21 as the Vcom-correction voltage Ve. Operational amplifier A22 receives a Vcom voltage Vc(2) and delivers the same after the impedance conversion through switch S22 as the Vcom-correction voltage Ve. Similarly, operational amplifier A2n receives a Vcom voltage Vc(n) and delivers the same after the impedance conversion through switch S2n as the Vcom-correction voltage Ve.

The switch block 34 receives the polarity control signal 106, which specifies to close one of the switches in each of the switch groups, with the other switches being open in the each of the switch groups.

Figure 5:
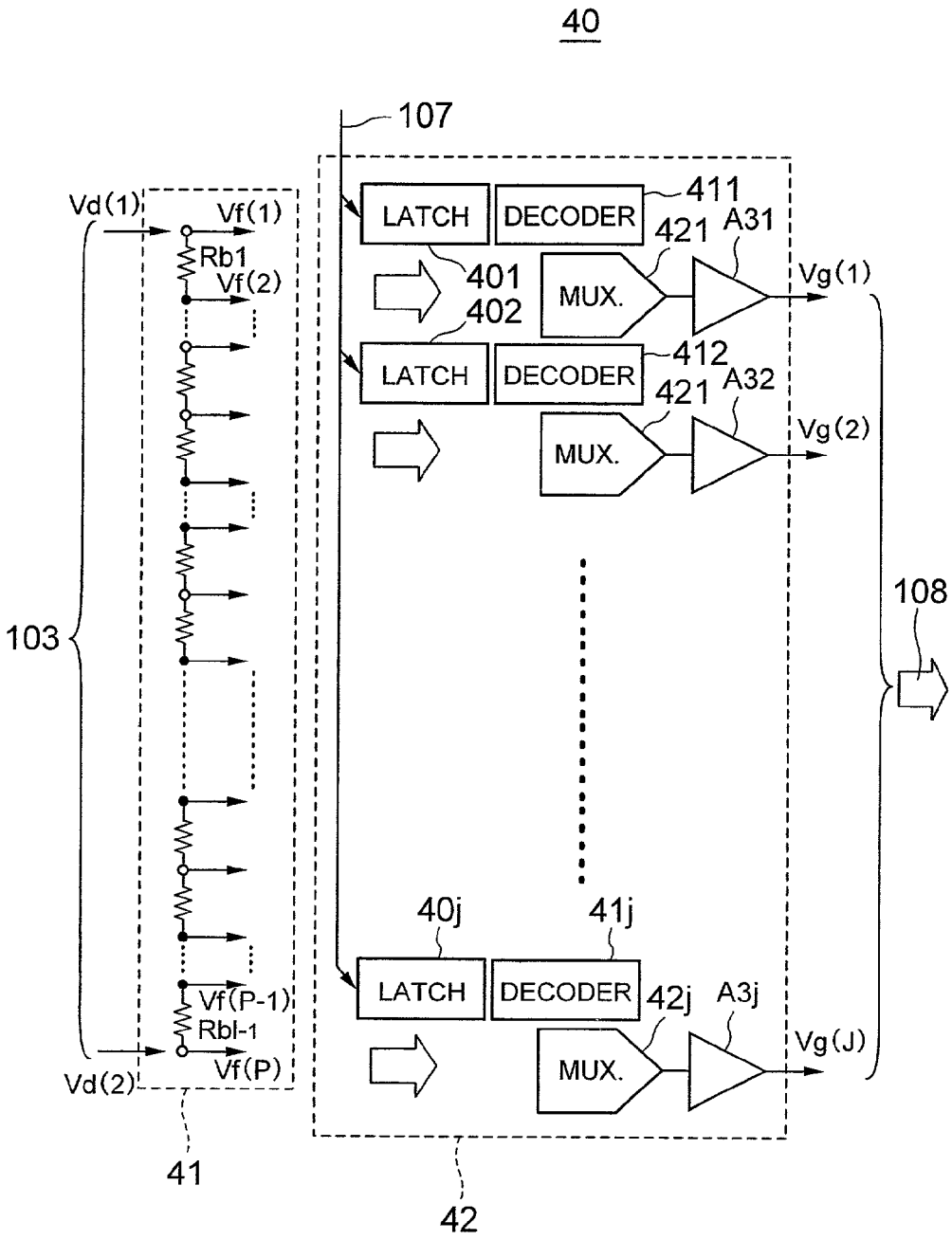
FIG. 5 is a block diagram of the LCD driver shown in FIG. 2.

Referring to FIG. 5, the LCD driver 40 includes a γ-correction resistor string 41 and a display data output block 42. The γ-correction resistor string 41 includes (P−1) resistors $Rb_1$–$Rb_p$ connected in series, which have specified resistances for approximating the optical transmittance profile, or γ-profile, of the LC layer as a whole. The γ-correction voltages Vd(1) and Vd(2) are supplied at both the ends of the γ-correction resistor string 41.

The γ-correction resistor string 41 divides the voltage between the voltage Vd(1) and the voltage Vd(2) to output the divided voltages Vf(1)–Vf(P) to the display data output block 42.

The display data output block 42 includes J output sections each including a data latch $\mathbf{40}_1$–$\mathbf{40}_J$, a decoder $\mathbf{41}_1$–$\mathbf{41}_J$, a multiplexer $\mathbf{42}_1$–$\mathbf{42}_J$ and an operational amplifier $\mathbf{43}_1$–$\mathbf{43}_J$. The functions of each output block except for the operational amplifier $\mathbf{43}_1$–$\mathbf{43}_J$ is similar to the γ-voltage generator section or the Vcom-voltage generator section of the voltage generator block 20. The number J corresponds, for example, the number of columns of the pixels on the screen of the LCD panel. That is, each display data output section delivers the output signal to a corresponding data line of the LCD panel.

Each display data output section receives a data signal 107, and selects one of the voltages Vf(1)–Vf(P) on the taps of the γ-correction resistor string 41 independently of the other display data output sections.

The number (P) of the output voltages of the γ-correction resistor string 41 corresponds to the number of gray-scale levels designed for the LCD panel 60.

Back to FIG. 2, the output signals of the LCD driver 40 are applied to data electrodes (not shown) of the LCD panel through the data lines, whereas the Vcom voltage selected by the impedance converter 30 is applied to the common electrode (not shown) of the LCD panel 60.

Upon power-on of the LCD control unit of the present embodiment, the γ-correction voltage signals 103 and the Vcom-voltage signal 104 to be supplied to the LCD driver 40 and the LCD panel 60, respectively, are specified by the voltage address signal 105 of the signal controller 50 for adjustment of the LCD device. The signal controller 50 is controlled by a software and writes specified data in the register installed therein. The specified data stored in the LCD device is changed when the LCD panel 60 is first installed or replaced in the LCD device.

Now, the adjustment for the LCD device will be described. It is assumed that the number n of the output voltages from the γ-voltage generator block 22, the number m of the output voltages from the Vcom-voltage generator block 21, the number X=nL of taps of the adjustment resistor string 21, and the number P of the gray scale levels of the LCD panel 60 are 4, 2, 256 and 64, respectively.

The software for the signal controller 50 specifies the settings of the γ-correction voltages and the Vcom-voltage on the voltage address signal 105, and controls the AC driving scheme by the polarity control signal 106.

The γ-voltage addresses in the voltage address signal 105 of the high-potential voltage and the low-potential voltage during a positive-polarity drive are set at 1 and 2, respectively. The γ-voltage addresses of the high-potential voltage and the low-potential voltage during a negative-polarity drive are set at 1 and 2, respectively. The Vcom-voltage address in the voltage address signal 105 is set at 3 during both the positive- and negative-polarity drive.

The polarity control signal 106 specifies based on the settings that switches S11*a*, S13*b* and S21 be selected during a positive-polarity drive and that switches S12*a*, S14*b* and S2m be selected during a negative-polarity drive.

The adjustment resistor string 21 generates 256 voltages Va(1)–Va(256), which are received by the γ-voltage generator block 22. The Vcom-voltage generator block 22 receives voltages Va(1)–Va(64) and voltages Va(193)–Va(256).

The multiplexer 221 selects Va(1) among the voltages Va(1)–Va(64) based on the voltage address signal 105, and delivers a voltage Vb(1) corresponding to Va(1). The multiplexer $\mathbf{22}_2$ selects Va(65) among the voltage Va(65)–Va(128), and delivers a voltage Vb(2) corresponding to Va(65). The multiplexer $\mathbf{22}_3$ selects Va(130) among the voltages Va(129)–Va(192) based on the voltage address signal 105, and delivers a voltage Vb(3) corresponding to Va(130). The multiplexer $\mathbf{22}_4$ selects Va(194) among the voltages Va(193)–Va(256) based on the voltage address signal 105, and delivers a voltage Vb(4) corresponding to Va(194).

The multiplexer $\mathbf{25}_1$ selects Va(3) among the voltages Va(1)–Va(64) based on the voltage address signal 105, and delivers a voltage Vc(1) corresponding to Va(3). The multiplexer $\mathbf{25}_2$ selects Va(195) among the voltage Va(193)–Va(256), and delivers a Vcom-correction voltage Vc(2) corresponding to Va(195).

That is, if the γ-correction voltages of first and third groups are selected, the Vcom voltage of the fourth group is selected. On the other hand, if the γ-correction voltages of the second and fourth groups are selected, the Vcom voltage of the first group is selected.

The γ-correction resistor string 41 divides the voltage between Vd(1) and Vd(2) into 64 sections to output voltages Vf(1)–Vf(64) at the taps thereof. Each of the J display data output sections in the display data output block 42 independently selects one of the voltages Vf(1)–Vf(64) based on the data signal received from outside the LCD device, to thereby output a display data signal 108 having 64-gray-scale levels.

During a positive-polarity drive, each display voltage Vg of the display data signal 108 assumes a maximum of Vf(1)=Vd(1)=Vb(1)=Va(1) and a minimum of Vf(64)=Vd(2)=Vb(3)=Va(130), whereas the Vcom voltage Ve assumes a maximum of Ve=Vc(1)=Va(195).

During a negative-polarity drive, each display voltage Vg of the display data signal 108 assumes a maximum of Vf(1)=Vd(1)=Vb(2)=Va(65) and a minimum of Vf(64)=Vd(2)=Vb(4)=Va(194), whereas the Vcom voltage Ve assumes a maximum of Ve=Vc(2)=Va(3).

In the LCD control unit of the present embodiment, the voltage address signal 105 and the polarity control signal 106, which are supplied from the signal controller 50 based on a software, control the γ-correction voltages and the Vcom voltage, whereby the γ-correction voltages and the Vcom voltage can be adjusted by the software without using a hardware work such as addition of external resistors in the initial adjustment. In addition, the LCD control unit fabricated as a one-chip IC can be mounted on the LCD panel instead of the conventional LCD driver, whereby the number of members for the LCD device can be reduced to achieve smaller dimensions and lower costs of the LCD device.

In the exemplified configuration of the above embodiment, the γ-correction voltages included Vd(1) and Vd(2). However, the γ-correction voltages may include three or more voltages, which are applied to one or more tap of the γ-correction resistor string 41 in addition to both the ends thereof. In such a case, for example, voltages Vd(1), Vd(2) and Vd(3) may correspond to Vf(1), Vf(L/2) and vf(L), respectively. By using such a configuration, the adjustment of a higher voltage side and a lower voltage side can be separately conducted to improve the accuracy of the adjustment of the γ-correction voltage to the γ-profile or optical transmittance of the LCD panel.

Since the above embodiment is described only for an example, the present invention is not limited to the above embodiment and various modifications or alterations can be easily made therefrom by those skilled in the art without departing from the scope of the present invention.

What is claimed is:

1. An LCD control unit for driving an LCD panel in an LCD device, said LCD control unit, comprising:

a signal controller for generating a voltage address signal and a polarity control signal;

a voltage generator block, directly coupled to said signal controller, for internally generating a plurality of (n) γ-voltage levels and a plurality of (m) Vcom-voltage levels, said voltage generator block including a voltage selecting block, wherein output of said voltage generating block is selected by said voltage selecting block from said plurality of (n) γ-voltage levels and said plurality of (in) Vcom-voltage levels according to a value of said voltage address signal input to said voltage generator block;

an impedance converter block, coupled to said signal controller and coupled to and separate from said voltage generator block, that converts input impedances of the γ-voltage levels and the Vcom-voltage levels provided by said voltage generator block and provides as output a specified number of said γ-correction voltages and said Vcom voltage according to a value of said polarity control signal; and an LCD driver for generating a set of display data signals based on a set of external data signals, wherein said LCD driver receives said specified number of said γ-correction voltages output from said impedance converter and includes a γ-correction section for correcting voltages of said display data signals based on said specified number of said γ-correction voltages.

2. The LCD control unit as defined in claim 1, wherein said voltage address signal and said polarity control signal are generated based on a software as time series signals.

3. The LCD control unit as defined in claim 1, wherein said voltage generator block includes a resistor string for generating n =L voltage levels, n first decoders for selecting said n γ-voltage levels from said n =L voltage levels based on said voltage address signal, and m second decoders for selecting said m Vcom-voltage levels from said n =L voltage levels based on said voltage address signal, given number L being an integer.

4. The LCD control unit as defined in claim 1, wherein said specified number of γ-correction voltages are a pair of γ-correction voltage.

5. The LCD control unit as defined in claim 4, wherein said voltage selecting block alternately selects said pair of γ-correction voltages having a positive polarity and said pair of γ-correction voltages having a negative polarity, with respect to said Vcom voltages.

6. The LCD control unit as defined in claim 1, wherein said voltage generator block includes a resistor string for generating a plurality of voltage levels, a decoder for decoding said voltage address signal, and a selector for selecting one of said γ-voltage levels or one of said Vcom voltage levels.

7. The LCD control unit as defined in claim 1, wherein said LCD control unit is a one-chip IC.

8. A display control unit for driving a display panel in a display device, said display control unit comprising:

a signal controller for generating a voltage address signal and a polarity control signal;

a voltage generator block, directly coupled to said signal controller, for internally generating a plurality of (n) γ-voltage levels and a plurality of (m) Vcom-voltage levels, said voltage generator block including a voltage selecting block, wherein output of said voltage generating block is selected by said voltage selecting block from said plurality of(n) γ-voltage levels and said plurality of (m) Vcom-voltage levels according to a value of said voltage address signal input to said voltage generator block;

an impedance converter block, coupled to said signal controller and coupled to and separate from said voltage generator block, that converts input impedances of the γ-voltage levels and the Vcom-voltage levels provided by said voltage generator block and provides as output a specified number of said γ-correction voltages and said Vcom voltage according to a value of said polarity control signal; and;

a display driver for generating a set of display data signals based on a set of external data signals, wherein said display driver receives said specified number of said γ-correction voltages output from said impedance converter and includes a γ-correction section for correcting voltages of said display data signals based on said specified number of said γ-correction voltages.

9. The display control unit as defined in claim 8, wherein said γ-correction section generates a plurality of voltages based on said specified number of said γ-correction voltages, and said voltages of display data signals are selected from said plurality of voltages generated by said γ-correction section based on said set of external data signals.

* * * * *